United States Patent [19]

Frankfurt

[11] 3,946,748

[45] Mar. 30, 1976

[54] TOBACCO FILTER FOR SMOKING ARTICLES

[76] Inventor: Sandor Frankfurt, 20550 University Blvd., Shaker Heights, Ohio 44122

[22] Filed: Sept. 19, 1974

[21] Appl. No.: 507,413

Related U.S. Application Data

[63] Continuation of Ser. No. 325,925, Jan. 22, 1973, abandoned.

[52] U.S. Cl. ..... 131/261 R; 131/10.5; 131/10.7

[51] Int. Cl.[2] ..... A24B 15/02

[58] Field of Search ..... 131/261 R, 267 X, 10 R, 131/10.5, 10.7

[56] References Cited

UNITED STATES PATENTS

| | | | |
|---|---|---|---|
| 1,975,152 | 10/1934 | Horwitz | 131/10 R X |
| 2,818,073 | 12/1957 | Taylor | 131/267 X |
| 3,010,458 | 11/1961 | Lebert | 131/10.5 X |
| 3,347,245 | 10/1967 | Hawkins | 131/10.5 X |
| 3,674,540 | 7/1972 | Pergaminos | 131/267 X |
| 3,714,949 | 2/1973 | King | 131/261 R X |

FOREIGN PATENTS OR APPLICATIONS

| | | | |
|---|---|---|---|
| 1,579,891 | 7/1969 | France | 131/10.7 |
| 852,705 | 11/1939 | France | 131/265 |

*Primary Examiner*—Robert W. Michell
*Assistant Examiner*—V. Millin

[57] ABSTRACT

A tobacco filter for smoking articles includes a holder having a tubular configuration and a filter medium disposed within the holder. The filter medium comprises a 2 × 2 twill woven double napped cotton fabric which has been treated with a sodium chloride solution containing sodium silico aluminate, dextrose, and potassium iodide. As the smoke travels through the 2 × 2 twill woven double napped cotton fabric treated with the sodium chloride solution the fabric absorbs and adsorbs many of the harmful constituents of the tobacco smoke to reduce the potential harm a user of the tobacco article may suffer. Means are provided for compressing the filter medium disposed in the holder at locations which are spaced apart along the longitudinal axis of the holder. The means for compressing the filter medium preferably comprise a plurality of projections disposed on the holder at spaced apart locations along the longitudinal axis of the holder. The spaced apart projections engage with the filter medium to compress the filter medium at spaced apart locations to enable the filter medium to remove harmful constituents from the smoke of the burning tobacco. Preferably, the projections also act as baffel members to provide a tortuous path for the tobacco smoke through the filter medium to further reduce the harmful constituents of the tobacco smoke that reaches a user of the smoking article.

6 Claims, 9 Drawing Figures

TOBACCO FILTER FOR SMOKING ARTICLES

This is a continuation of application Ser. No. 325,925, filed Jan. 22, 1973, now abandoned.

BACKGROUND OF THE INVENTION

The present invention relates to a tobacco filter for smoking articles and more particularly to a tobacco filter having a holder for supporting a filter medium composed of a 2 × 2 twill woven cotton fabric which has been chemically treated and wherein the holder acts to compress the filter medium at spaced apart locations along the longitudinal axis of the holder.

Many techniques have been utilized to remove harmful constituents from tobacco smoke. Some known tobacco filters rely on filter mediums which are chemically treated to remove harmful constituents from the tobacco smoke. These known filters are treated with various chemicals such as weak basic inorganic salts as disclosed in the Sloan U.S. Pat. No. 3,417,758 and inorganic water soluble salts as disclosed in the Sublett U.S. Pat. No. 3,428,056. Other known tobacco filters attempt to direct the flow of the smoke through a tortuous path in the filter in an attempt to remove harmful by-products from the tobacco smoke. To this end baffels have been employed in the filters such as the one disclosed in the Wang U.S. Pat. No. 3,313,304.

SUMMARY OF THE PRESENT INVENTION

The present invention provides a new and improved tobacco filter for smoking articles. The tobacco filter includes an elongate holder which supports a filter medium therein. Preferably, the filter medium comprises a 2 × 2 twill woven cotton fabric which is double napped. The construction of the 2 × 2 twill woven fabric is such as to maximize the retention therein of harmful constituents in the tobacco smoke. The double napping of the fabric increases the surface area of the fabric which comes in contact with the tobacco smoke to thereby increase the adsorption and absorption by the fabric of the dangerous constituents of the tobacco smoke. The double napping also increases the tortuous path through which tobacco smoke travels to thereby cool the smoke and provide for condensation of liquids in the smoke. The filter medium is chemically treated with a sodium chloride solution containing sodium silico aluminate, dextrose and potassium iodide to further increase the filter mediums ability to remove harmful constituents from the tobacco smoke. The chemical treatment of the cotton fabric increases the fabrics absorption and adsorption capabilities and significantly reduces the amount of liquids which are carried by the tobacco smoke through the filter medium.

The holder for the filter medium has an elongate construction with openings at opposite ends thereof. A plurality of projections are formed on the interior portion of the holder at locations which are spaced apart along the longitudinal axis of the holder. The projections engage with the filter medium to compress the filter medium at spaced apart locations. The compression of the filter medium at spaced apart locations by the projections causes the filter medium to trap a greater quantity of the harmful constituents of the tobacco smoke. The projections also act as baffels to further increase the tortuous path through which the tobacco smoke flows. Moreover, since the projections are at a cool temperature relative to the tobacco smoke they act to trap and condense tars thereon thereby further purifying the tobacco smoke. Thus, the filter for smoking articles functions to remove a large percentage of the harmful constituents from the tobacco smoke to thereby reduce the potential harm the smoke might cause to the user of the tobacco article.

Accordingly, an object of the present invention is to provide a new and improved tobacco filter for smoking articles including a holder having a filter medium therein and wherein the filter medium includes a 2 × 2 twill woven double napped cotton fabric treated with a sodium chloride solution to improve the filter mediums retention of the harmful constituents of the tobacco smoke.

Another object of the present invention is to provide a new and improved tobacco filter for smoking articles as set forth in the next preceding object wherein the filter medium is treated with a sodium chloride solution containing sodium silico aluminate, dextrose and potassum iodide.

Still another object of the present invention is to provide a new and improved tobacco filter for smoking articles including a tubular holder, a filter medium disposed within the holder and means for compressing the filter medium at spaced apart locations along the longitudinal axis of the holder.

A further object of the present invention is to provide a new and improved tobacco filter for smoking articles including a tubular holder having an elongate configuration and a plurality of projections spaced apart along the longitudinal axis of the holder for engaging with a filter medium supported within the holder and wherein the projections compress the filter medium at spaced apart locations along the longitudinal axis of the holder to provide alternate areas wherein the filter medium is compressed and non-compressed.

DESCRIPTION OF THE DRAWINGS

These and other objects of the present invention will become apparent from the following detailed description of a preferred embodiment of the present invention taken in conjunction with the accompanying drawings wherein.

DESCRIPTION OF A PREFERRED EMBODIMENT OF THE INVENTION

The present invention relates to a tobacco filter for a smoking article which includes a holder and a filter medium disposed in the holder. The holder with the filter medium can be attached to a smoking article to remove a large majority of the harmful constituents from the tobacco smoke. The holder has a tubular configuration with a plurality of spaced apart projections located on an interior surface thereof. The projections engage with the filter medium and compress the filter medium at spaced apart locations along the longitudinal axis of the holder to provide alternate areas wherein the filter material is compressed and relatively non-compressed. The filter medium is preferably a 2 × 2 twill woven double napped cotton fabric which has been treated with a sodium chloride solution containing sodium silico aluminate, dextrose, and potassium iodide. The filter medium and the holder cooperate to form a filter which effectively removes harmful constituents from the tobacco smoke and traps the constituents interiorly of the holder and filter medium to prevent them from escaping therefrom.

Figure 1:
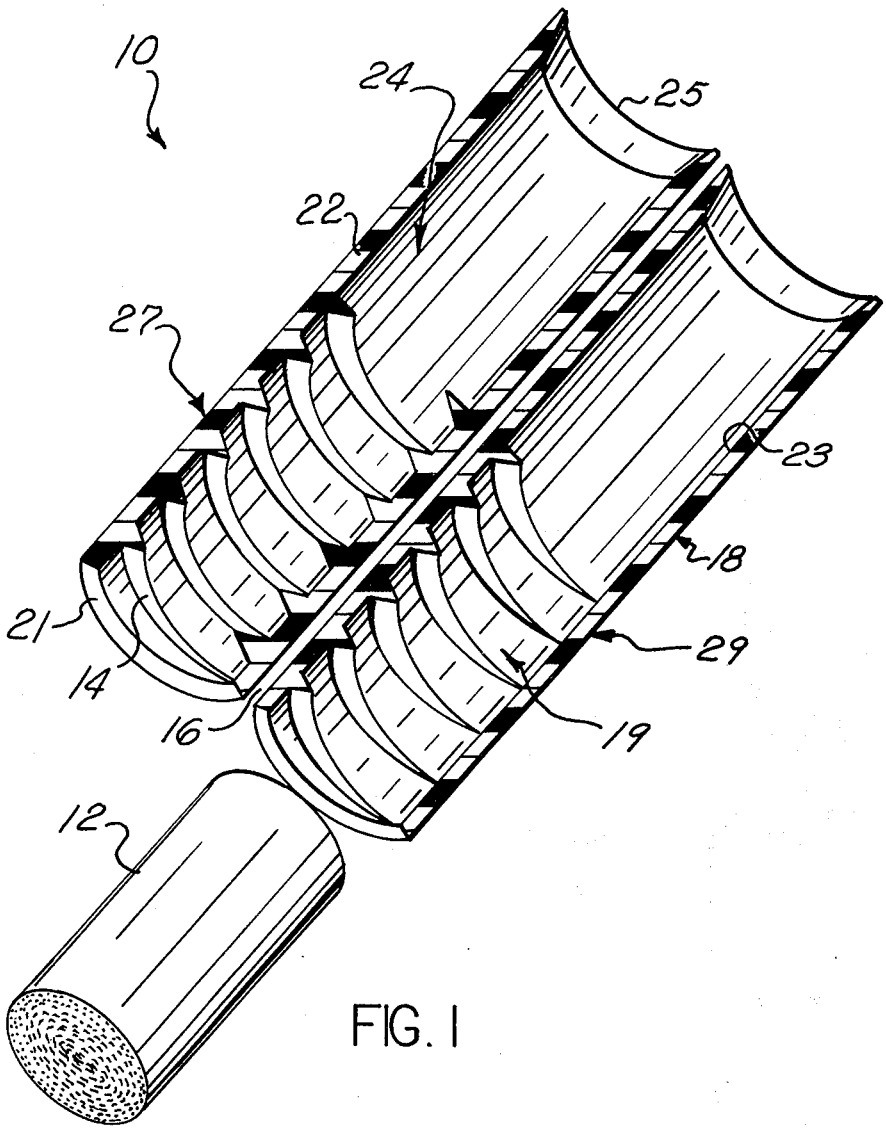
FIG. 1 is a perspective view of the holder in an open position before the filter medium has been inserted therein.

Referring to FIG. 1, a tobacco filter 10 is illustrated for filtering the smoke from a tobacco product such as a cigar or cigarette. The tobacco filter 10 includes a tubular holder 18 within which is disposed a filter medium 12. The holder 18 includes a tubular wall 22 having end portions 21 and 25. During normal usage of the filter 10 the end portion 21 is attached in a well known manner to a tobacco article such as a cigarette (not shown). When the cigarette is smoked, the user of the cigarette establishes a partial vacuum at the end portion 25 of the holder 18 to affect the flow of smoke from the cigarette, through the filter medium 12 and out the end portion 25 to the user of the tobacco article. The tubular wall 22 defines a cavity 24 through which the smoke travels from the tobacco to the user. The filter medium 12 is located in the cavity 24 and operates to filter the smoke as it passes therethrough.

Figure 2:
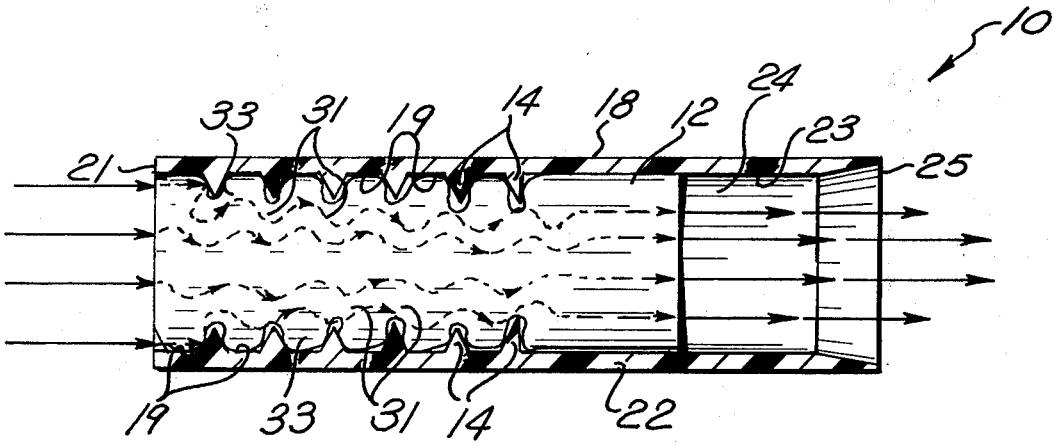
FIG. 2 is a cross sectional view with the filter medium disposed in the holder.

The holder 18 is preferably formed of one piece and is divided into portions 27 and 29 which are connected by a hinged portion 16. The hinged portion 16 enables the portions 27 and 29 of the holder 18 to be separated to provide insertion of the filter medium 12 into the cavity 24 of the holder 18. When the filter medium 12 is inserted in the cavity 24 of the tubular holder 18 the portions 27 and 29 may be rotated about the hinged portion 16 to close the holder 18 and hold the filter medium 12 in place in the cavity 24 as is shown in FIG. 2. The tubular walls 22 include a plurality of projections 14 disposed thereon which engage with the filter medium 12 when the holder 18 is closed to compress the filter medium 12 at spaced apart locations along the longitudinal axis of the holder 18. The projections 14 also grip the filter medium 12 to support the filter medium 12 in the cavity 24 and prevent movement of the filter medium 12 relative to the holder 18.

When the filter medium 12 is supported in the cavity 24 of the holder 18, the projections 14 disposed on the interior surface of the holder 18 engage with the filter medium 12 to compress the filter medium 12 at spaced apart locations 31 along the longitudinal axis of the holder 18 as is more fully illustrated in FIG. 2. The engagement of the projections 14 with the filter medium 12 compresses the filter medium at locations 31 adjacent to the portions of the filter medium which are in engagement with the projections 14. The projections 14 located on the interior surface of the holder 18 are spaced apart by relatively flat surfaces 19. The filter medium 12 that is disposed adjacent to the flat surfaces 19 at locations 33 is in a state of non-compression when compared relative to the portions of the filter medium 12 at locations 31 which are engaged with the projections 14. This construction causes the filter medium 12 to have alternate compressed and non-compressed areas with the compressed areas 31 being disposed adjacent to the projections 14 and the non-compressed areas 33 being disposed adjacent to the flat surfaces 19. The alternate areas of compression and non-compression of the filter medium 12 causes the smoke that flows thereto to take a tortuous path which effectively cools the smoke and reduces the harmful constituents contained therein. Since the projections 14 engage with only the outer portions of the filter medium 12, the outer locations 31 disposed adjacent to the projections 14 tend to be compressed greater than the interior portions of the filter medium 12. In other words, if a cross sectional view were taken through the filter medium 12 disposed adjacent to a projection 14, the compression of the filter medium 12 would decrease as the distance the filter medium is located from the projection 14 is increased. This construction causes the smoke that passed through the filter medium 12 to assume a tortuous path due to the alternate areas of compression and non-compression of the filter medium 12. When the smoke enters a compressed area of the filter medium 12, the smoke tends to be pressed into close contact with the filter medium 12. The close contact causes harmful constituents such as tars and nicotine of the tobacco smoke to be absorbed and adsorbed by the filter material 12, thus removing these harmful constituents from the smoke. Moreover, when the smoke enters a compressed area the smoke tends to flow toward the center of the filter medium 12 away from the projections 14 due to the fact that the interior portions of the filter medium 12 is less compressed than the portions of the filter medium 12 disposed adjacent to the projections 14. This flow of the smoke increases the length of the path that the smoke must travel.

When the smoke enters a relatively non-compressed area of the filter medium 12 disposed adjacent to the flat surfaces 19, the smoke tends to expand. The expansion of the smoke also increases the length of the path that the smoke travels and also increases the contact of the smoke with the filter medium 12. It should be apparent that the greater the length of the path through the filter medium 12 the greater the absorption and adsorption capabilities of the filter medium 12. The smoke is then again compressed as it flows through the next compressed area adjacent to the next sequential projection 14 and more harmful constituents are forced therefrom.

The alternate compression and expansion of the smoke causes the smoke to travel a tortuous path which is longer than the path the smoke travels if the smoke traveled through a filter which was all compressed or all non-compressed. Moreover, the alternate compression and expansion of the filter enables the smoker of the tobacco to easily draw the smoke whereas if the filter material is all compressed the flow of smoke through the filter medium would be inhibited.

The projections 14 also act as baffel members in that smoke flowing along the interior surface 23 of the holder 18 engages with the projections 14 and is forced to flow around these projections. Since the projections are formed on the wall 22 of the holder 10, they are relatively cooler than the interior portions of the filter medium 12. This causes harmful constituents of the tobacco smoke, especially harmful liquid constituents such as tars, to condense on the projections 14 thereby removing these harmful constituents from the smoke.

While the filter medium and the projections thereon have been illustrated, as only partially extending through the longitudinal length of the holder 18 it is contemplated that the projections 14 could extend along the whole longitudinal length of the holder and the filter medium 12 could also extend the whole longitudinal length of the holder 18. Moreover, while projections 14 have been illustrated in the figures other means of alternating compressing the filter medium 12 could be utilized. For example, means could be utilized on the exterior portion of the holder 18 to form alternate areas of compression and non-compression in the filter medium 12. These means could be in the form of bands which compress the tubular wall portion 22 of the holder 18 at spaced apart locations disposed along longitudinal length of the holder 18 to thereby create alternate areas of compression and non-compression in the filter medium 12.

Figure 3:
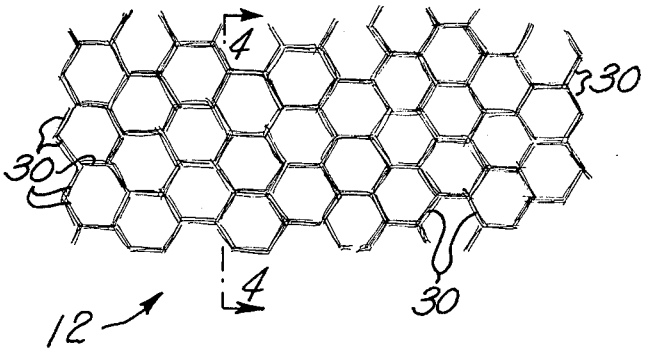
FIG. 3 is a planar view of a material having a plurality of ridges thereon for use as the filter medium.
Figure 4:
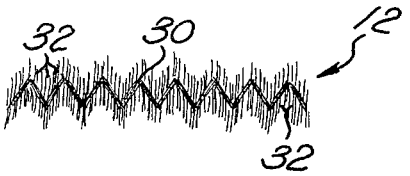
FIG. 4 is a cross sectional view taken approximately along the lines 4—4 of FIG. 3 more fully illustrating the ridges of the filter medium.
Figure 9:
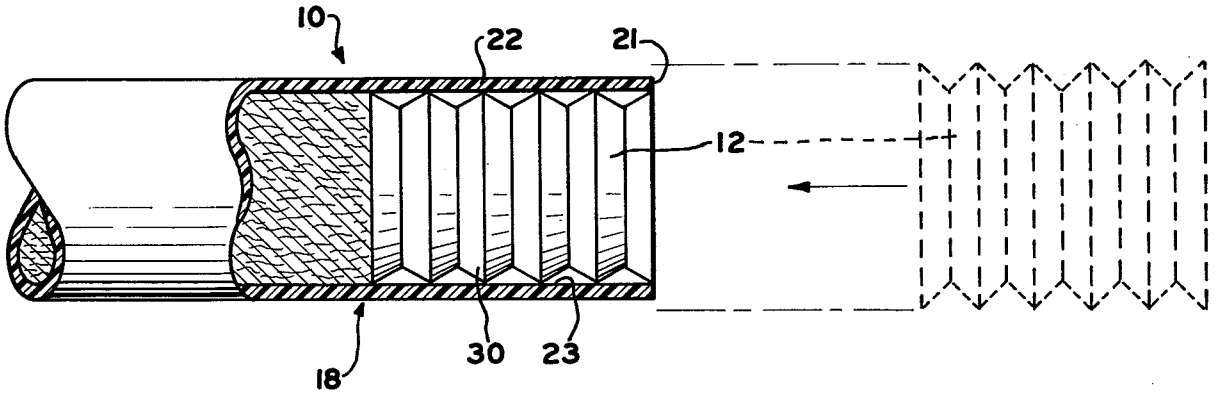
FIG. 9 is a schematic illustrating another embodiment of the present invention wherein ridges having a diameter greater than that of the holder are utilized to compress the filter medium throughout spaced apart cross sectional planes.

Another method of forming alternate areas of compression and non-compression in the filter medium 12 would be to form the filter medium with projections thereon as illustrated in FIG. 9 which when engaged with the interior surface 23 of the holder 18 would effect compression of the filter medium 12 adjacent to the ridges located thereon. The areas of the filter medium 12 not associated with a ridge would be in a relatively non-compressed state. To this end FIG. 3 and 4 illustrate a filter medium having a plurality of ridges or projections 30 disposed thereon. The utilization of the ridges 30 in the filter medium 12 could be with or without (as illustrated in FIG. 9), the utilization of the projections 14 located on the interior surface 23 of the holder 18. The filter medium 12 illustrated in FIGS. 3 and 4 utilizes a plurality of projections 30 which form hexagonal shaped ridges across the surface of the filter medium 12. The ridges 30 would be disposed in the holder 18 in a direction substantially perpendicular to the flow of the smoke through the tobacco article as illustrated in FIG. 9. Moreover, the ridges 30 should be disposed in engagement with the interior surface 23 of the holder 18 to affect the compression of the filter medium 12 adjacent to the ridges 30.

Preferably, the filter medium 12 illustrated in FIGS. 3 and 4 is a textile material which has a double nap disposed on opposite sides thereof. The double napping provides a plurality of filaments 32 through which the smoke must pass prior to exiting from the holder 18. The filaments 32 increase the effective surface area of the filter medium 12 to enable the filter medium 18 to absorb and adsorb the harmful constituents of the tobacco smoke. The napping of the filter medium preferably extends in a direction substantially perpendicular to the flow of smoke through the filter medium 12 to thereby increase the surface contact between the smoke and the filter medium 12.

Figure 5:
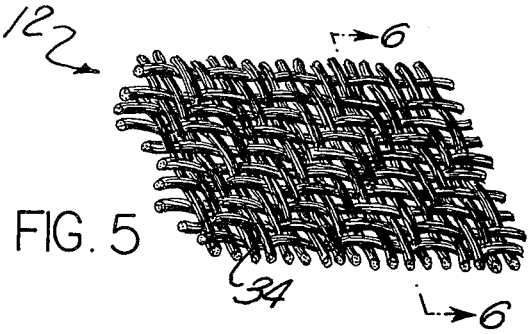
FIG. 5 is a perspective view of the 2 × 2 twill woven cotton material which is illustrated as a filter medium.
Figure 6:
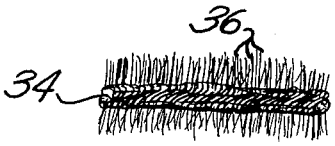
FIG. 6 is a cross sectional view taken approximately along the lines 6—6 of FIG. 5 more fully illustrating the double napping of the 2 × 2 twill woven cotton fabric.

FIGS. 5 and 6 illustrate another filter medium which may be utilized in the present holder. The filter medium 12 disclosed in FIG. 5 is a 2 × 2 twill single woven cotton fabric which has a double planetary nap disposed on opposite sides thereof. The 2 × 2 weave provides an excellent filter medium in that the smoke is forced to travel through a tortuous path around the individual threads 34 of the filter medium 12. Moreover, the double napping provides a plurality of filaments 36 on opposite sides of the 2 × 2 twill single woven cotton fabric to further increase the surface area thereof and increase the adsorption and absorption capabilities of the cotton fabric.

The 2 × 2 twill woven cotton fabric is treated with a sodium chloride solution containing potassium iodide, sodium silico aluminate, and dextrose, to improve the retention capabilities of the fabric to enable the fabric to remove a large percent of the harmful constituents from the tobacco smoke. Preferably, the sodium chloride solution is a one percent solution in water with 0.01 percent potassium iodide and dextrose added. These chemicals help to further enhance the ability of the cotton fabric to absorb harmful liquids such as tars and nicotine from the smoke. While the 2 × 2 twill woven cotton fabrc may be utilized in the present holder 18 without treating it with the sodium chloride solution the treatment of the cotton fabric substantially increases the fabric's ability to absorb liquids since many of the harmful constituents of the tobacco smoke take a liquid or vapor form when they travel through the filter medium 12. The chemical treatment of the fabric significantly increases the cotton's ability to remove the harmful constituents from the tobacco smoke. Moreover, the utilization of dextrose and potassium iodide increase the sweetness of the tobacco smoke to thereby increase the user's enjoyment of the smoking article. While the present embodiment of the invention contemplates the utilization of a sodium chloride solution to treat the filter medium it should be apparent that salts of alkali earth metals such as lithium, potassium and sodium with hallides such as florine, chlorine, bromine and iodine could also be utilized to treat the filter medium.

Figure 7:
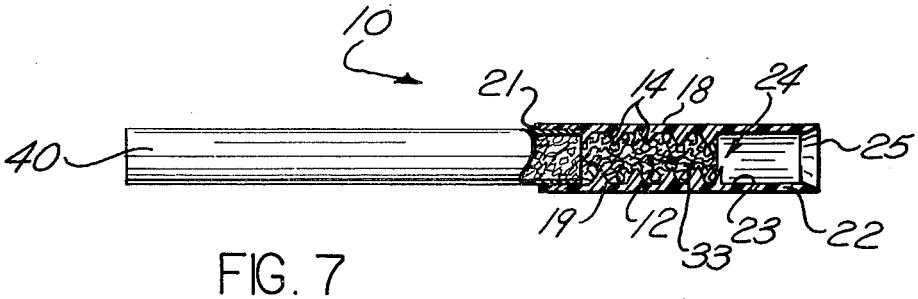
FIG. 7 is a partially cross sectioned view of a cigarette having the holder of the present invention attached at one end thereof.

Referring to FIG. 7, the 2 × 2 twill woven double napped cotton fabric is illustrated as utilized in the holder 18 attached to one end of a cigarette 40. When the cigarette is smoked, the smoke travels into the end portion 21 of the holder 18, through the filter medium 12, which in the present instance is a 2 × 2 twill woven double napped cotton fabric, around the projections 14 and out the end portion 25 of the holder 18. While the holder 18 and filter medium 12 are illustrated as permanently attached to the cigarette 40, it should be appreciated that the filter 10 could easily be a removable filter that could be attached to a cigarette 40 whether the cigarette 40 has a permanent filter or not. Thus, the present invention of the filter 10 could be utilized in a disposable filter for tobacco articles which could be attached to the tobacco article by the user of the article prior to smoking thereof.

Figure 8:
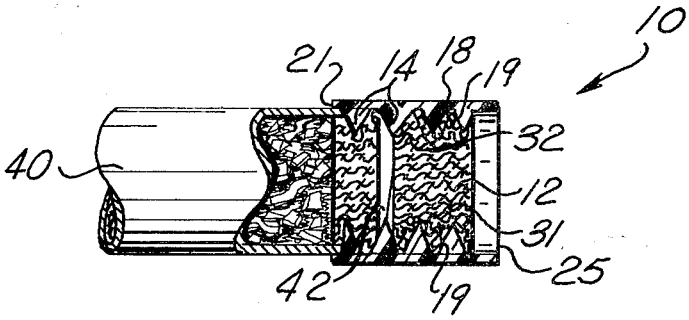
FIG. 8 is a fragmentary view of a cigarette with another embodiment of the filter attached thereto.

FIG. 8 illustrates another embodiment of the present invention wherein the filter medium 12 comprises two separate portions of 2 × 2 twill woven cotton fabric with a liquid impermeable membrane 42 inserted therebetween. The liquid impermeable membrane 42 further removes liquids from the tobacco smoke and enhances the filtering capabilities of the 2 × 2 twill woven cotton fabric. It has been found that many of the major harmful constituents of the tobacco smoke are in a liquid or vapor form when they pass through the filter medium 12. Thus, the provision of the liquid impermeable membrane 42 increases the filtering of the smoke before it reaches a user of the tobacco article. In this embodiment the 2 × 2 twill woven cotton fabric operates in the same manner to remove the harmful constituents of the tobacco smoke as the filter medium 12 illustrated in FIG. 5. However, the further addition of the liquid impermeable membrane 42 further increases the ability of the cotton fabric to remove the harmful constituents from the tobacco smoke.

From the foregoing it should be apparent that a new and improved filter for tobacco articles has been provided. The filter includes a tubular elongate holder having a plurality of projections therein which cooperate with the filter medium to provide alternate compressed and non-compressed areas of the filter medium disposed along the longitudinal axis of the holder. The alternate compressed and non-compressed areas cause the tobacco smoke to assume a tortuous path as it flows through the filter medium to increase the filter mediums' ability to absorb and adsorb harmful constituents from the tobacco smoke. The filter medium comprises a 2 × 2 twill woven double napped cotton fabric which is treated with a sodium chloride solution containing sodium silico aluminate, dextrose and potassium iodide. The 2 × 2 twill woven cotton fabric with its double planetary napping absorbs and adsorbs the harmful constituents from the tobacco smoke. The chemical treatment of the cotton fabric with the sodium chloride solution increases the fabric's ability to absorb liquids which constitute a large portion of the harmful constituents of the tobacco smoke. The utilization of the chemically treated 2 × 2 twill woven cotton fabric in the holder having the plurality of projections thereon provides a filter for tobacco articles which removes a large majority of the harmful constituents from the tobacco smoke thereby decreasing the health hazard presented to the user of the tobacco article.

I claim:

1. A tobacco filter for smoking articles comprising a holder for a filter medium, said holder having a substantially tubular configuration defining a substantially cylindrical chamber with openings at opposite end portions thereof, a solid unitary compressible filter medium disposed in said cylindrical chamber of said holder for removing harmful constituents from tobacco smoke that flows therethrough, said filter medium having a diameter as least as large as the diameter of said cylindrical chamber to effect engagement of said filter medium with the wall of said cylindrical chamber along substantially the entire length of said filter medium to fill said cylindrical chamber along at least a major portion of the longitudinal axis thereof, and a plurality of ridge means integrally formed with said wall of said cylindrical chamber for radially compressing said filter medium at all points throughout each of a plurality of spaced apart cross sectional planes at locations which are spaced apart along the longitudinal axis of said holder and disposed substantially perpendicular to the longitudinal axis of said filter medium to provide alternate cross sectional portions of compressed and noncompressed filter medium along the longitudinal axis of said filter medium.

2. A tobacco filter as defined in claim 1 wherein said plurality of ridge means form a baffle means disposed substantially perpendicular to the longitudinal axis of said holder for compressing said filter medium throughout said spaced apart cross sectional planes at said spaced apart locations and for trapping harmful constituents of the smoke from burning tobacco, said baffle means extending in a direction substantially perpendicular to the flow of smoke from the tobacco article through said holder and said filter medium.

3. A tobacco filter as defined in claim 1 wherein said ridge means for compressing said filter medium comprises an interior surface of said holder having threads formed thereon, which engage with said filter medium at said spaced apart locations to compress said filter medium at said locations which are spaced apart along the longitudinal axis of said holder.

4. A tobacco filter as defined in claim 1 wherein said filter means comprises a 2 × 2 twill woven cotton fabric which is napped on both sides thereof, said napping increasing the surface area of said cotton fabric which engages with the smoke as it flows through said cotton fabric to increase said cotton fabric's ability to absorb and adsorb harmful constituents from the tobacco smoke prior to the smoke reaching a user of the tobacco article.

5. A tobacco filter for smoking articles comprising a holder for a filter medium, said holder having a substantially tubular configuration defining a substantially cylindrical chamber with openings at opposite end portions thereof, a unitary filter medium disposed in said cylindrical chamber of said holder for removing harmful constituents from tobacco smoke that flows therethrough, and a plurality of ridge means integrally formed with said wall of said cylindrical chamber for radially compressing said filter medium at all points throughout a plurality of cross sectional planes disposed at locations which are spaced apart along the longitudinal axis of said holder to provide alternate cross sectional portions of compressed filter medium having a first density and noncompressed filter medium having a second density which is less than said first density along the longitudinal axis of said filter medium, said ridge means for compressing said filter medium including a plurality of projections disposed on the wall of said cylindrical chamber of said holder and spaced apart along the longitudinal axis of said holder, said projections engaging with the filter medium at spaced apart locations along the length of the filter medium to form said portions of compressed filter medium.

6. A tobacco filter for smoking articles comprising a holder for a filter medium, said holder having a substantially tubular configuration defining a substantially cylindrical chamber with openings at opposite end portions thereof, a solid compressible filter medium disposed in said cylindrical chamber of said holder for removing harmful constituents from tobacco smoke that flows therethrough, said filter medium having a diameter at least as large as the diameter of said cylindrical chamber to effect engagement of said filter medium with the wall of said cylindrical chamber along substantially the entire length of said filter medium to fill said cylindrical chamber along at least a major portion of the longitudinal axis thereof, and means for compressing said filter medium throughout spaced apart cross-sectional planes at locations which are spaced apart along the longitudinal axis of said holder and disposed substantially perpendicular to the longitudinal axis of said filter medium to provide alternate cross-sectional portions of compressed and noncompressed filter medium along the longitudinal axis of said filter medium, said filter medium comprising a material having a plurality of ridges spaced apart along the longitudinal axis of said filter medium, said filter medium having a diameter at said ridges which is greater than the diameter of said cylindrical chamber to enable said ridges to cooperate with the wall of the cylindrical chamber of said holder when said filter medium is disposed therein to compress said filter medium throughout said spaced apart cross-sectional planes at said spaced apart locations along the longitudinal axis of said filter medium where said ridges engage with the wall of said cylindrical chamber of said holder.

* * * * *

UNITED STATES PATENT AND TRADEMARK OFFICE

CERTIFICATE OF CORRECTION

PATENT NO. : 3,946,748

DATED : September 19, 1974

INVENTOR(S) : Sandor Frankfurt

It is certified that error appears in the above-identified patent and that said Letters Patent are hereby corrected as shown below:

Col. 2, line 55 change "illustrated" to --utilized--.

Col. 3, line 46 after "provide" insert --for--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*